US008857614B2

(12) United States Patent
Gordon

(10) Patent No.: US 8,857,614 B2
(45) Date of Patent: Oct. 14, 2014

(54) CONTAINER OF WIPES WITH DISPENSING NOZZLE

(76) Inventor: Michael John Gordon, Farnham Royal (GB)

( * ) Notice: Subject to any disclaimer, the term of this patent is extended or adjusted under 35 U.S.C. 154(b) by 708 days.

(21) Appl. No.: 12/664,179

(22) PCT Filed: Aug. 29, 2007

(86) PCT No.: PCT/GB2007/003267

§ 371 (c)(1),
(2), (4) Date: Mar. 30, 2010

(87) PCT Pub. No.: WO2008/025980

PCT Pub. Date: Mar. 6, 2008

(65) Prior Publication Data

US 2010/0176021 A1 Jul. 15, 2010

(30) Foreign Application Priority Data

Aug. 29, 2006 (GB) ..... 0617067.4
Jun. 4, 2007 (GB) ..... 0710596.8

(51) Int. Cl.
*A47K 10/32* (2006.01)

(52) U.S. Cl.
CPC ..... *A74K 10/3818* (2013.01)
USPC ..... 206/494; 206/233; 221/63

(58) Field of Classification Search
USPC ..... 206/494, 210, 233, 449, 812, 409; 221/63, 33, 307
See application file for complete search history.

(56) References Cited

U.S. PATENT DOCUMENTS

| | | | | | |
|---|---|---|---|---|---|
| 3,749,296 | A | * | 7/1973 | Harrison | 225/106 |
| 4,171,047 | A | * | 10/1979 | Doyle et al. | 206/210 |
| 4,180,160 | A | | 12/1979 | Ogawa | 206/210 |
| 4,262,816 | A | * | 4/1981 | Margulies | 221/46 |
| 4,784,290 | A | * | 11/1988 | Howard | 221/63 |
| 4,905,868 | A | * | 3/1990 | Beane et al. | 221/44 |
| 5,215,211 | A | * | 6/1993 | Eberle | 221/1 |
| 5,219,126 | A | * | 6/1993 | Schutz | 242/560 |
| 5,246,137 | A | | 9/1993 | Schutz | 224/44 |
| 5,263,607 | A | * | 11/1993 | Temesvary et al. | 221/304 |
| 5,273,184 | A | * | 12/1993 | Rizzuto | 221/303 |

(Continued)

FOREIGN PATENT DOCUMENTS

| | | | |
|---|---|---|---|
| DE | 8707614 | | 11/1988 |
| DE | 4006987 | | 9/1991 |
| EP | 0110473 | A1 * | 11/1983 |
| EP | 0107487 | | 5/1984 |

*Primary Examiner* — Steven A. Reynolds
(74) *Attorney, Agent, or Firm* — Andrew Wilford

(57) ABSTRACT

The invention relates to a container (1) of wipes with a dispensing nozzle (20). A housing (2A, 2B) is provided containing wipes (10). The wipes (10) formed on a continuous sheet of impregnated material with spaced lines of perforations (11) dividing the sheet of material into wipes. A dispensing nozzle (20) extends from the housing. The nozzle (20) is formed with a resilient aperture (21) through which wipes can be withdrawn from the housing. The resilient aperture (21) is expandable to allow withdrawal of (wipes 10) therethrough, but is biased towards a contracted state. In use a wipe can be withdrawn through the nozzle and separated by rupturing the perforations joining the wipe to a next adjacent wipe with the nozzle expanding as required to allow passage of the wipe through the nozzle aperture. The nozzle contracts around the tail of the next adjacent wipe to prevent release of moisture from the inside of the housing and to help prevent wicking of moisture from a wipe tail.

11 Claims, 3 Drawing Sheets

(56) References Cited

U.S. PATENT DOCUMENTS

| | | | | | |
|---|---|---|---|---|---|
| 5,310,083 | A * | 5/1994 | Rizzuto | 221/63 |
| 5,542,568 | A * | 8/1996 | Julius | 221/63 |
| 5,560,514 | A * | 10/1996 | Frazier | 221/63 |
| 5,718,353 | A * | 2/1998 | Kanfer et al. | 221/63 |
| 5,868,346 | A * | 2/1999 | Cobos | 242/593 |
| 6,129,240 | A * | 10/2000 | Morand | 221/63 |
| 6,158,614 | A * | 12/2000 | Haines et al. | 221/63 |
| 6,186,374 | B1 | 2/2001 | Gross | 22/494 |
| 6,328,252 | B1 | 12/2001 | Neveu | 242/593 |
| 6,499,626 | B1 * | 12/2002 | Julius | 221/63 |
| 6,910,579 | B2 * | 6/2005 | Reinke et al. | 206/494 |
| 7,216,775 | B2 * | 5/2007 | Evans et al. | 221/63 |
| 2006/0261076 | A1 | 11/2006 | Anderson | 221/33 |
| 2010/0264159 | A1 * | 10/2010 | Gordon | 221/46 |

* cited by examiner

CONTAINER OF WIPES WITH DISPENSING NOZZLE

CROSS REFERENCE TO RELATED APPLICATIONS

This application is the US national phase of PCT application PCT/GB2007/003267, filed 29 Aug. 2007, published 5 Mar. 2008 as WO2008/025980, and claiming the priority of British patent application 0617067.7 itself filed 29 Aug. 2006 and British patent application 0710596.8 itself filed 4 Jun. 2007, whose entire disclosures are herewith incorporated by reference.

FIELD OF THE INVENTION

The present invention relates to a container of wipes with a dispensing nozzle.

BACKGROUND OF INVENTION

It is well known to house wipes in containers. Such containers typically comprise a cylindrical housing with a sealed end and an open end. Wipes are stored in the housing. An end cap is typically provided for the open end, which seals the container ideally in an hermetically sealed environment. An aperture is also provided in the end cap through which wipes are dispensed and which is usually located in a recess which receives the end cap.

Wipes are usually in the form of elongate continuous sheets of moistened or impregnated material with spaced lines of perforations dividing one sheet of material into hand-sized wipes or towelettes. In use of such containers, when a wipe is withdrawn through the aperture, a line of perforations ruptures and a wipe is released from the sheet of material, with the intention of leaving a tail of the next wipe projecting through the cap aperture.

PRIOR ART

An example of a container is described in German Offenlegungschrift DE-A1-40 06 987 (Penaten). The dispenser has an orifice through which sheets of material are pulled. Mention is made of the applications of such sheets or tissues and the various mixtures and types of liquid with which they may be impregnated.

There are three main problems associated with such containers. Often when a wipe is withdrawn from the container, the line of perforations ruptures before the wipe is fully withdrawn through the cap aperture. This results in the tail of the next wipe being left inside the container. The result is that a user needs to remove the cap and feed the tail of the next wipe to be dispensed through the cap aperture.

Another problem has been that lines of perforations separating the wipes has occasionally fail to rupture as the wipe was removed resulting in a 'stream' of wipes being inadvertently extracted when only one was required.

A further problem was that wipes, which were intended to be moist, but if the container if wipes is stored and not used for a length of time, the wipes dry out due to wicking and because vapour can emerge from the container through the cap aperture.

International Patent Application Number WO-A1-2006/124429 (BKI Holding Corp) to some extent solved the third problem and provides a container for wipes having a centre pull feed arrangement for dispensing sheets, typically off a roll. The dispenser includes a tray that supports a web roll which removes excess moisture form a sheet that is being dispensed and returns moisture, by way of a wicking action, to the remaining sheets within the container.

Another dispenser is described in U.S. Pat. No. 5,246,137 (James River Paper Company) discloses a device for dispensing individual sheets from a roll wherein the dispenser is in the form of a nozzle. However, it is not apparent how successful this device is at retaining moisture within the container, thereby ensuring that wipes, when dispensed are sufficiently wet.

U.S. Pat. No. 6,328,252 (Georgia Pacific France) discloses a dispenser for wipes which are intended to unwind from the centre of a roll outwards towards the of the roll. The container includes a nozzle that has a generally frustoconical shape that is shaped and oriented to ease the introduction of as free end of a roll of wipes into and through the orifice. The dispenser shown is relatively complex and comprises a significant number of discrete and relatively complex moulded items.

Another container is described in U.S. Pat. No. 6,186,374 (Seaquist Closures Foreign Inc), which discloses a container for dispensing wipes with a structure extending from the body of the container which defines a dispensing surface for directing a stream of wipes from the roll (housed within the container) to a nozzle region from where a single wipe may be torn.

The container has a lid which defines a passage through the lid. A flexible valve is provided through which wipes pass. The flexible valve has self sealing slits which flex in order to permit the passage of towels. However, there still remains the problem, when withdrawing wipes from the container, that either perforations rupture before the wipe is fully withdrawn or lines of perforations separating the wipes fail to rupture, resulting in a 'stream' of wipes being dispensed.

It is thus apparent that a conflict of two conflicting requirement is present. On the one hand it is essential that the container remains as close to an hermetically sealed environment as possible, so as to ensure the wipes retain moisture; whereas on the other hand, too tight a grip on the wipes as they are being withdrawn, imparted by the dispensing orifice, either gives rise to unpredictable or premature tearing of the wipes.

The invention overcomes the aforementioned problems and provides an improved dispenser which is cheap to fabricate and which is easy and reliable to operate.

SUMMARY OF THE INVENTION

According to a first aspect of the invention there is provided a container of wipes with a dispensing nozzle comprising:

a) a housing containing wipes, said wipes being formed on a continuous sheet of impregnated material with spaced lines of perforations dividing the sheet of material into wipes, and b) a dispensing nozzle extending from the housing, said nozzle being formed with a resilient aperture through which wipes can be withdrawn from the housing, said resilient aperture being biased towards a first contracted position and being expandable to a second expanded position as a wipe is extracted through the aperture to allow withdrawal of wipes therethrough, in use a wipe can be withdrawn through the nozzle and separated by rupturing the perforations joining the wipe to a next adjacent wipe with said nozzle expanding as required to allow passage of the wipe through the nozzle aperture, and said nozzle contracting around the tail of the next adjacent wipe to prevent release of moisture from the inside of the housing and to help prevent wicking of moisture from a wipe tail.

According to a second aspect of the invention there is provided a container of wipes with a dispensing nozzle comprising:

a) a housing, which in use receives wipes, said wipes being formed on a continuous sheet of impregnated material with spaced lines of perforations dividing the sheet of material into wipes, and b) a dispensing nozzle extending from the housing, said nozzle being formed with a resilient aperture through which wipes can be withdrawn from the housing, the aperture being expandable to allow withdrawal of wipes therethrough and biased towards a contracted state as a wipe is extracted through the aperture, whereby, in use, a wipe is withdrawn through the nozzle and separated by rupturing the perforations joining the wipe to an adjacent wipe, as the nozzle contracts around the tail of the next adjacent wipe.

According to a third aspect of the invention there is provided a nozzle for use with the container, the nozzle comprising: a projection, which is adapted to flex toward a direction a wipe is being withdrawn, the projection being formed from a resiliently deformable material; has an aperture defined therein; and is biased into a contracted state, thereby maintaining the container substantially sealed, through which aperture, in use, a wipe passes, characterised in that, the material has a coefficient of static friction, such that a force applied to withdraw a towelette or wipe is sufficiently small as not to inadvertently tear towelettes or wipes at the onset of pulling; and the coefficient of dynamic friction is sufficiently large to exert a gripping force on the wipe, so as to apply a force of sufficient magnitude as to permit a towelette to pass through the aperture, promote the onset of tearing of the wipe along a preformed line of weakness and leave a tail of a subsequent wipe exposed.

Ideally the nozzle is shaped to prevent release of moisture from the inside of the housing and to help prevent wicking of moisture from a wipe tail. The invention overcomes existing problems and drawbacks associated with dispensing moist wipes as the inventor has appreciated that there is an optimum friction force that needs to be applied. This friction force must be sufficiently small as not to damage (tear) towelettes or wipes at the onset of pulling, but to be sufficiently small to permit the towelette or wipe to be withdrawn. This friction is known as the coefficient of static friction. However, once a wipe is in motion and is being drawn through the orifice a different form of friction is in precedence. This is referred to as dynamic friction and is smaller than the coefficient of static friction. This is partly due to kinetics and partly due to the liquid boundary established between the tissue and the aperture defined in the nozzle. However, the nozzle must still be able to exert sufficient gripping force on the wipe so as to apply a force of sufficient magnitude as to enable or promote the onset of tearing of the wipe.

Preferably therefore the nozzle is dimensioned such that any force pulling the wipe back through the aperture, into the housing, biases the nozzle aperture into a contracted state, thereby preventing premature rupture or tearing of the wipe and thus avoiding the need to re-thread a tail of a wipe through the aperture.

Preferably the nozzle is formed from a flexible projection whereby the nozzle flexes toward a direction a wipe is being withdrawn.

Ideally ribs, pips or some similar form of gripping means is disposed on an inner surface of the nozzle. These ribs, pips or gripping means are preferably formed form the same material as the nozzle and are resiliently deformable so as to accommodate movement of a wipe being removed form the container.

Ideally ribs, pips or gripping means are formed integrally with the nozzle and ideally in a single shot injection moulding process.

Ribs, pips or any other raised region may be formed in a pattern which is circularly symmetric or radially symmetric around and inner portion of the nozzle in the region of the orifice, so that these raised ribs or portions are able to engage with a wipe.

Ribs, pips or any other raised region may be disposed in the form of a continuous spiral or at intervals so as to optimise grip.

In a particularly preferred embodiment, the nozzle moves from a first contracted position to a second expanded position as a wipe is extracted through the aperture. Part of the nozzle adjacent the aperture is adapted to invert when moving from the first contracted position to the second expanded position.

Preferably the nozzle is generally teat-shaped and tapers from a widened base to a tip, and an aperture is provided in the tip.

In another embodiment the container further supports a set of teeth spaced from the nozzle which engage into perforations in the sheet of material as a wipe is withdrawn to separate a wipe from an adjacent wipe.

In a further embodiment the nozzle wall, so as to assist with insertion of a wipe, tapers in an inward direction from a widened base, and then curves outwards, into an annular projection defining an aperture inside the wall of the projection. As mentioned above the inside wall of the projection advantageously supports one or more ribs, gripping means or ratchet teeth to grip a wipe to help prevent a wipe passing back through the nozzle into the container.

Preferably the nozzle projects beyond the outer surface of the container.

The container of the invention may be used in conjunction with a dispenser as described in the Applicant's copending International Patent Application Number PCT/GB07/03189 the contents of which are incorporated herein by reference.

BRIEF DESCRIPTION OF FIGURES

Embodiments of the invention will now be described with reference to the drawings in which.

DETAILED DESCRIPTION OF PREFERRED EMBODIMENTS OF THE INVENTION

Figure 1:
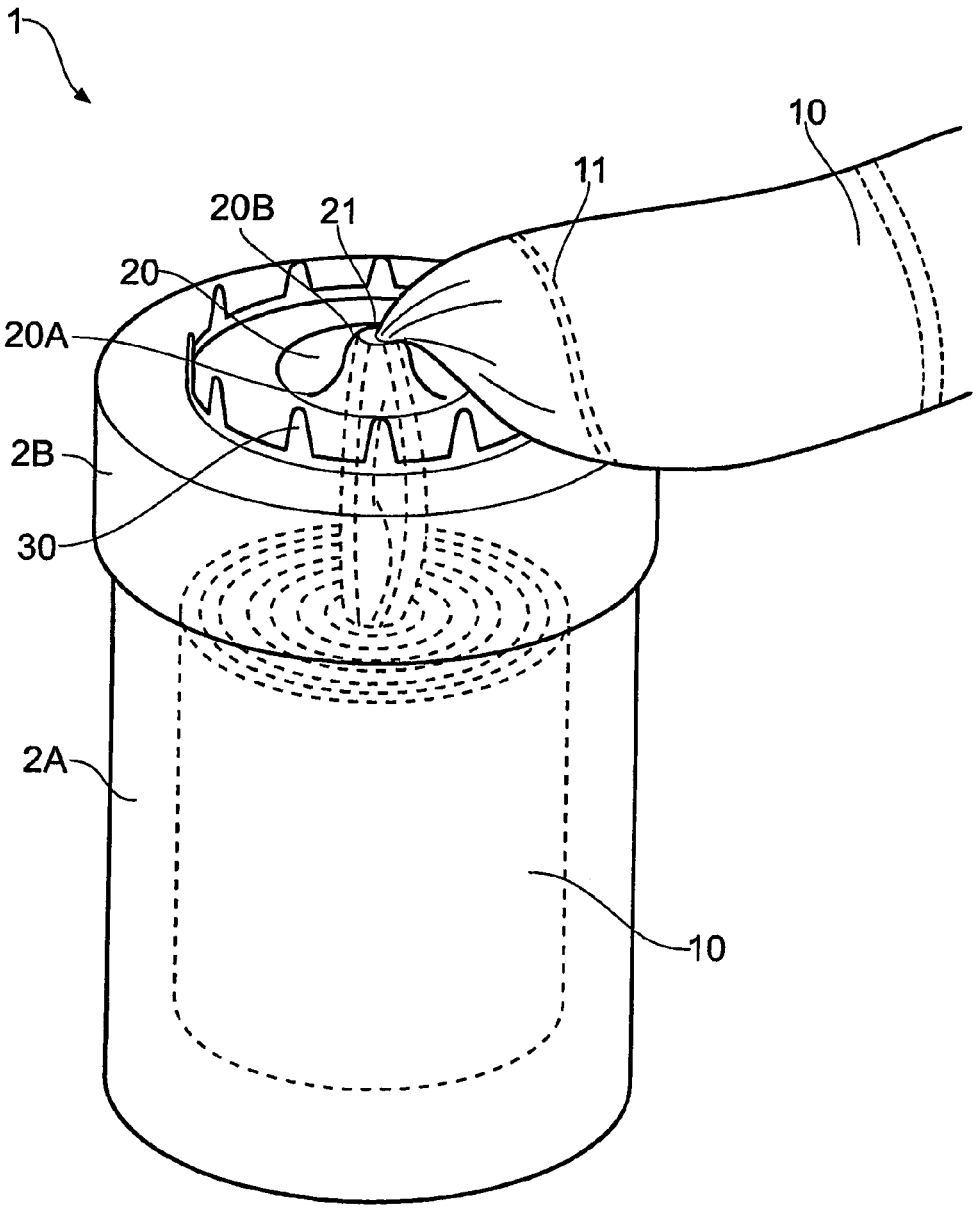
FIG. 1 shows a perspective view of an embodiment of a container.

Referring to FIG. 1, there is shown a container 1 of wipes with a dispensing nozzle. Container 1 has a housing formed from cylindrical base 2A with one closed end and an end cap 2B which screws onto the other end of base 2A. Container 1 houses a roll of wipes 10, with the wipes being formed on a continuous sheet of impregnated material with spaced lines of perforations 11 dividing the sheet of material into wipes.

A teat like rubber dispensing nozzle 20, typically formed from polyurethane, synthetic plastics or similar elastomeric material, extends from an aperture in the end cap 2B and, as shown, projects beyond the outer surface of the container 1.

Nozzle 20 is therefore beyond the aperture of the dispenser so as to enable easy access to the wipe if used in conjunction with a dispenser as described in the aforementioned International Patent Application.

Nozzle 20 tapers from a widened base 20A to a tip 20B, and is formed with a resilient aperture 21 through which wipes can be withdrawn from the housing as shown. The resilient aperture 21 is expandable to allow withdrawal of wipes 10 therethrough but being biased towards a contracted state. Nozzle 20 is flexible whereby the nozzle will flex toward a direction a wipe is being withdrawn.

In use a wipe 10 can be withdrawn through the nozzle 20 and separated by rupturing the perforation 11 joining the wipe to a next adjacent wipe with the nozzle expanding as required to allow passage of the wipe through the nozzle aperture. The nozzle then contracts around the tail of the next adjacent wipe to prevent release of moisture from the inside of the container 1 housing and to help prevent wicking of moisture from a wipe tail.

End cap 2B supports an annular set of teeth 30 spaced around the nozzle 20. Teeth engage into perforations in the sheet of material as a wipe is withdrawn to separate a wipe from an adjacent wipe. The teeth also ensure that the tail of the next adjacent wipe has a predetermined length substantially equal to the distance between the nozzle aperture and the teeth.

Nozzle 20 may take a variety of different shapes and constructions. A few examples are described below.

Figure 2A:
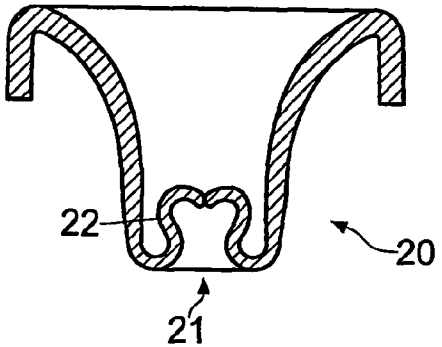
FIGS. 2A and 2B show an example of a nozzle in a contracted and expanded position.
Figure 2B:
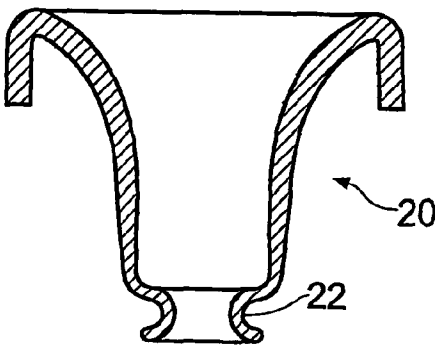

In FIGS. 2A and 2B there is shown in cross section a first embodiment of nozzle 20 with an aperture 21 defined by a rolled ring 22 which moves from a first contracted position (FIG. 2A) to a second expanded position (FIG. 2B) as a wipe is extracted through the aperture. As shown, part of the nozzle adjacent the aperture inverts when moving from the first contracted position to the second expanded position. The nozzle 20 is shaped such that any force pulling a wipe back through the aperture when in the expanded state into the housing biases the nozzle aperture from its expanded state into a contract state.

Figure 3A:
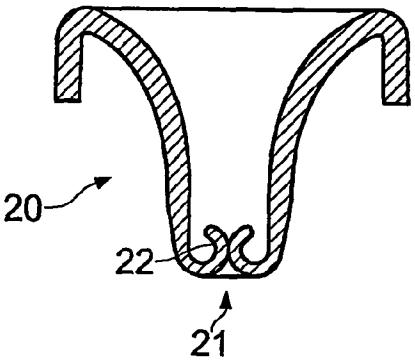
FIGS. 3A and 3B show an example of a second nozzle in a contracted and expanded position.
Figure 3B:
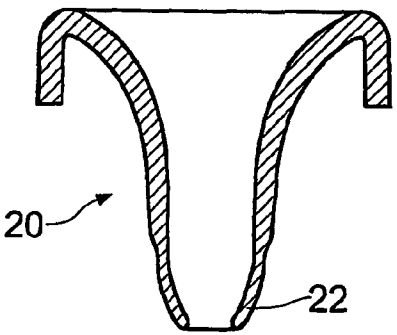

In FIGS. 3A and 38 there is shown in cross section, a further embodiment of nozzle 20 with an aperture 21 defined by a rolled tip 22 which moves from a first contracted position (FIG. 3A) to a second expanded position (FIG. 3B) as a wipe is extracted through the aperture 21. As shown, part of the nozzle adjacent the aperture inverts when moving from the first contracted position to the second expanded position. The nozzle is shaped such that any force pulling a wipe back through the aperture when in the expanded state into the housing biases the nozzle aperture from its expanded state into a contract state.

Figure 4A:
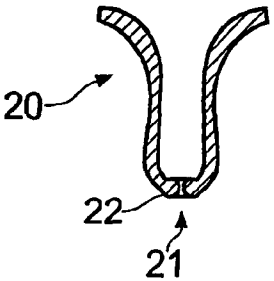
FIGS. 4A and 4B show an example of a third nozzle in a contracted and expanded position.
Figure 4B:
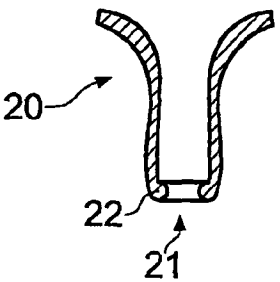

In FIGS. 4A and 4B there is shown in cross section a yet further embodiment of nozzle 20 with an aperture 21 defined by a curved tip 22 which moves from a first contracted position (FIG. 4A) to a second expanded position (FIG. 4B) as a wipe is extracted through the aperture 21.

Figure 5A:
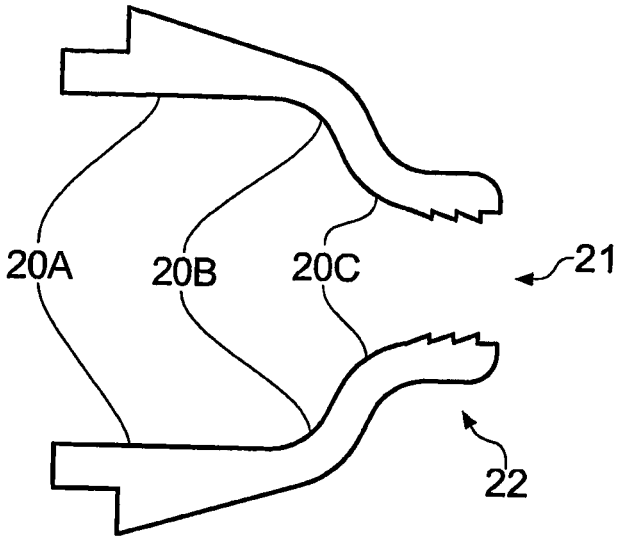
FIGS. 5A and 5B show an example of a third nozzle in a contracted and expanded position.
Figure 5B:
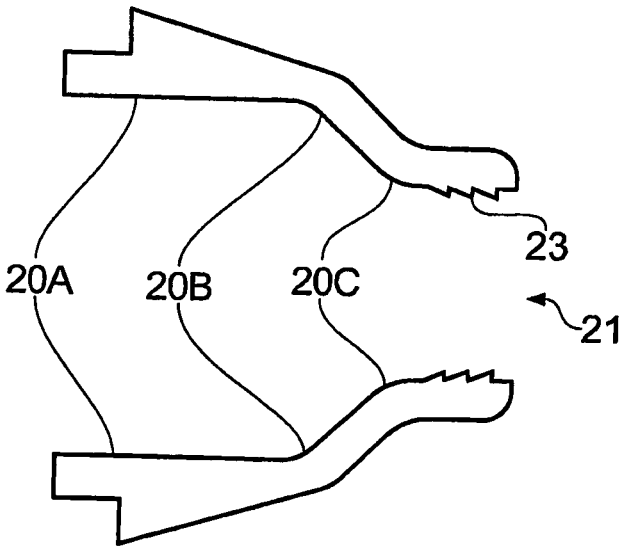

The invention may take a form different to that specifically described above. For example the teeth 30 could be omitted In FIGS. 5A and 5B there is shown in cross section a fourth embodiment of nozzle 20 with an aperture 21 defined by an annular projection 22 which moves from a first contracted position (FIG. 5A) to a second expanded position (FIG. 5B) as a wipe is extracted through the aperture 21. Before a wipe is inserted therein, nozzle 20 wall has a widened base 20A which tapers inwards towards 20B and then curves outwards 20C into the annular projection 22. The tapering inwards and curving outwards of the wall creates a funnel to funnel a wipe through the aperture smoothly. This prevents wipes from bunching and clogging the nozzle, or premature severance of perforations before a wipe has fully exited the aperture 21 and exposed the tail of the next adjacent wipe.

The inside wall of the annular projection 22 may support one or more annular ratchet teeth 23 to grip a wipe to help prevent a wipe falling back through the nozzle 20 into a container. Instead of annular ratchet teeth, one or more annular ribs (e.g. semi-circular in cross-section) may be used.

The nozzle herein described, when fitted into a container, may be used in conjunction with a dispenser as described in the Applicant's aforementioned International Patent Application. In this respect the housing for wipes of the present invention may have an external shape to match the internal shape of a wipe dispenser chamber. This ensures that the housing remains stable during heavy usage and ensures that the user positions the tub correctly upon insertion into a dispenser so as to correctly align the sealing cap of the tub with the receiving means on the dispenser.

Further modifications will be apparent to those skilled in the art without departing from the scope of the present invention.

The invention may take a form different to that specifically described above. For example nozzles may be formed integrally with a container or retro-fitted to existing containers.

Preferred embodiments of the invention have been described and it will be understood that features from one or more of the aforementioned embodiments may be incorporated into a different containers and/or nozzles.

Various embodiments of the invention have been described, by way of example only and it will be appreciated that variation may be made to the examples described without departing from the scope of the invention.

The invention claimed is:

1. A container for wipes, the container comprising:

a housing that in use receives the wipes, the wipes being formed on a continuous sheet of impregnated material with spaced lines of perforations dividing the sheet of material into the wipes, and a nonrotatable, one-piece dispensing nozzle extending from and fixedly mounted on the housing, the nozzle having a resiliently deformable nozzle wall formed with a resilient aperture through which wipes can be withdrawn from the housing, the nozzle wall having an inner surface, before a wipe is inserted therein, tapering inward from a widened base and then curving smoothly inward into a narrow annular projection defining the aperture that is resiliently expandable to an expanded state to allow withdrawal of wipes therethrough and that is biased toward the housing in a contracted state as a wipe is extracted through the aperture, the nozzle wall pointing outward from the housing in both the retracted state and the expanded state, whereby, in use, a wipe is withdrawn through the nozzle and separated by rupturing the perforations joining the wipe to an adjacent wipe as the nozzle contracts resiliently around a tail of the next adjacent wipe; and a set of teeth on the inner surface of the projection, spaced from the aperture, and engaging into the perforations in the sheet of material as a wipe is withdrawn to separate a wipe from an adjacent wipe, the inner surface being smooth and uninterrupted except at the teeth.

2. The container for wipes according to claim 1, wherein the nozzle contracting around the tail of the next adjacent wipe prevents release of moisture from the inside of the housing and wicking of moisture from a wipe tail.

3. The container for wipes according to claim 1, wherein the nozzle is shaped such that any force pulling a wipe back through the aperture into the housing biases the nozzle aperture into the contracted state.

4. The container for wipes according to claim 1, wherein the nozzle is formed from a flexible projection such that the nozzle flexes away from the housing in a direction as a wipe is being withdrawn.

5. The container for wipes according to claim 1, wherein the nozzle moves from the contracted state to the expanded state as a wipe is extracted through the aperture.

6. The container for wipes according to claim 1, wherein the nozzle projects beyond an outer surface of the container.

7. The container for wipes according to claim 1, wherein the nozzle has a coefficient of static friction such that a force applied to withdraw a wipe is sufficiently small as not to inadvertently tear wipes at the onset of pulling; and the coefficient of dynamic friction is sufficiently large to exert a gripping force on the wipe so as to apply a force of sufficient magnitude as to permit a wipe to pass through the aperture, promote the onset of tearing of the wipe along a preformed line of weakness and leave a tail of a following wipe exposed.

8. A container for wipes, the container comprising:

a housing that in use receives the wipes, the wipes being formed on a continuous sheet of impregnated material with spaced lines of perforations dividing the sheet of material into the wipes;

a nonrotatable, one-piece dispensing nozzle extending from and fixedly mounted on the housing, the nozzle having a resiliently deformable nozzle wall formed with a resilient aperture through which wipes can be withdrawn from the housing, the nozzle wall having an inner surface, before a wipe is inserted therein, tapering inward from a widened base and then curving smoothly inward into a narrow annular tip projection defining the aperture that is resiliently expandable to an expanded state to allow withdrawal of wipes therethrough and that is biased toward the housing in a contracted state as a wipe is extracted through the aperture, the nozzle wall pointing outward from the housing in both the retracted state and the expanded state, whereby, in use, a wipe is withdrawn through the nozzle and separated by rupturing the perforations joining the wipe to an adjacent wipe as the nozzle contracts resiliently around a tail of the next adjacent wipe;

ribs, pips or gripping formations fixed on the inner surface of the nozzle at the aperture in a circularly symmetric array and engaging into the perforations in the sheet of material as a wipe is withdrawn to separate a wipe from an adjacent wipe, the inner surface being smooth and uninterrupted except at the ribs, pips, or gripping formations.

9. The container for wipes according to claim 8 wherein the ribs or pips are arrayed at different radial intervals around the inner surface of the nozzle.

10. The container for wipes according to claim 8 wherein the ribs, pips or gripping formations are formed from the same material as the nozzle.

11. The container for wipes according to claim 8 wherein the ribs, pips or gripping formations are a continuous spiral or at intervals so as to optimize grip.

* * * * *